United States Patent [19]

Keller et al.

[11] 4,195,462

[45] * Apr. 1, 1980

[54] FABRICATED WOOD STRUCTURAL MEMBER

[75] Inventors: James R. Keller, Tualatin; William A. Nickerson, Portland, both of Oreg.

[73] Assignee: Wood I Systems, Inc., Portland, Oreg.

[ * ] Notice: The portion of the term of this patent subsequent to Nov. 16, 1996, has been disclaimed.

[21] Appl. No.: 899,153

[22] Filed: Apr. 24, 1978

Related U.S. Application Data

[63] Continuation-in-part of Ser. No. 809,176, Jun. 23, 1977, Pat. No. 4,123,315, which is a continuation-in-part of Ser. No. 743,532, Nov. 5, 1976, Pat. No. 4,074,498, which is a continuation-in-part of Ser. No. 558,350, Mar. 14, 1975, Pat. No. 3,991,535.

[51] Int. Cl.[2] ..... E04C 3/02

[52] U.S. Cl. ..... 52/690; 52/729; 52/730

[58] Field of Search ..... 52/690, 729, 730; 403/282, 364, 277, 290

[56] References Cited

U.S. PATENT DOCUMENTS

| | | | |
|---|---|---|---|
| 1,377,891 | 5/1921 | Knight | 52/729 X |
| 3,490,188 | 1/1970 | Troutner | 52/690 X |
| 3,991,535 | 11/1976 | Keller et al. | 52/690 X |
| 4,042,307 | 8/1977 | Jarvis | 403/277 X |

*Primary Examiner*—Carl D. Friedman

*Attorney, Agent, or Firm*—Lee R. Schermerhorn

[57] ABSTRACT

A particleboard web member interconnects a pair of wood chord members by means of glued tongue and groove joints to form an I-beam or roof truss. A pair of grooves in each chord member receives a pair of parallel tongues on the web member. The grooves are inclined from top to bottom to bend the tongues out of parallelism and form self-locking dovetail-type joints which hold the members together in assembled relation without the use of external clamps while the glue is setting.

4 Claims, 4 Drawing Figures

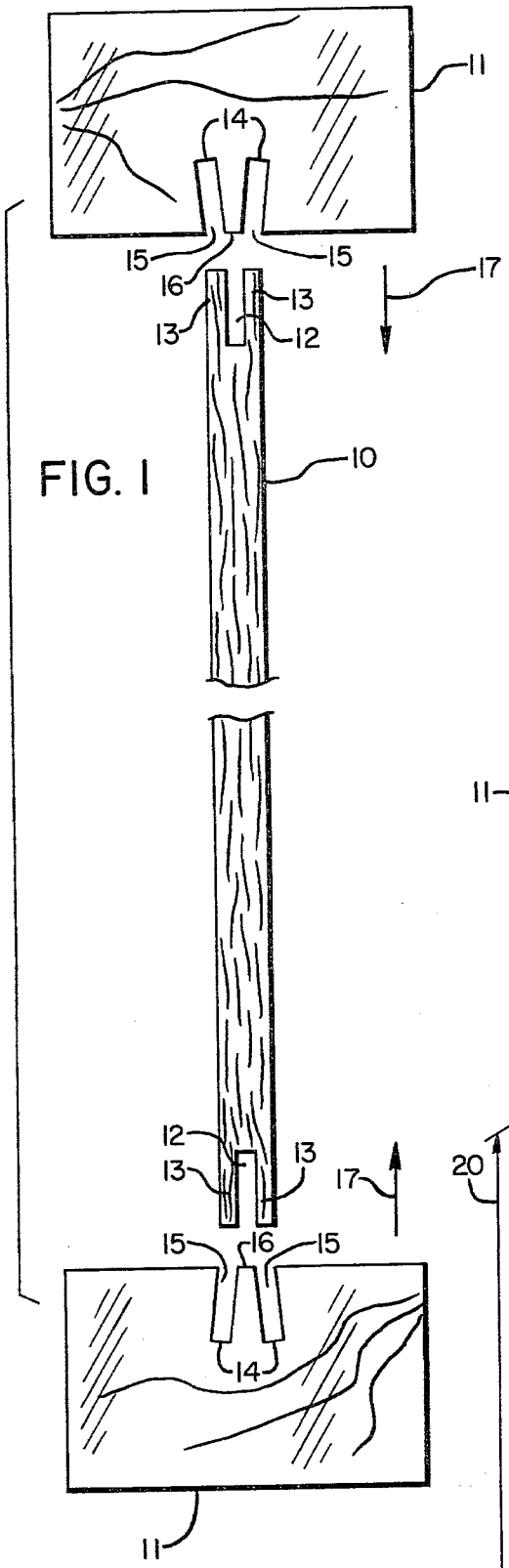
FIG. 1
FIG. 2
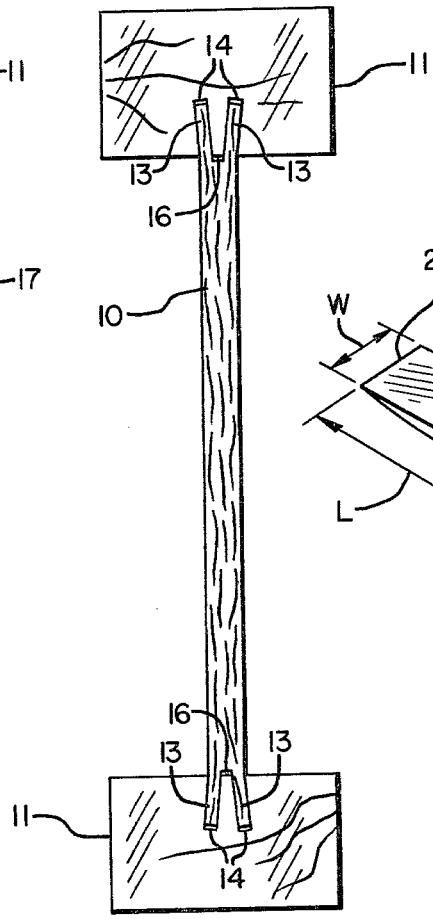
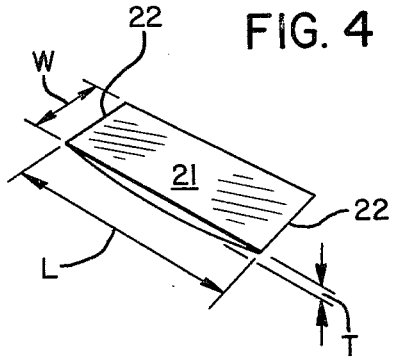
FIG. 4
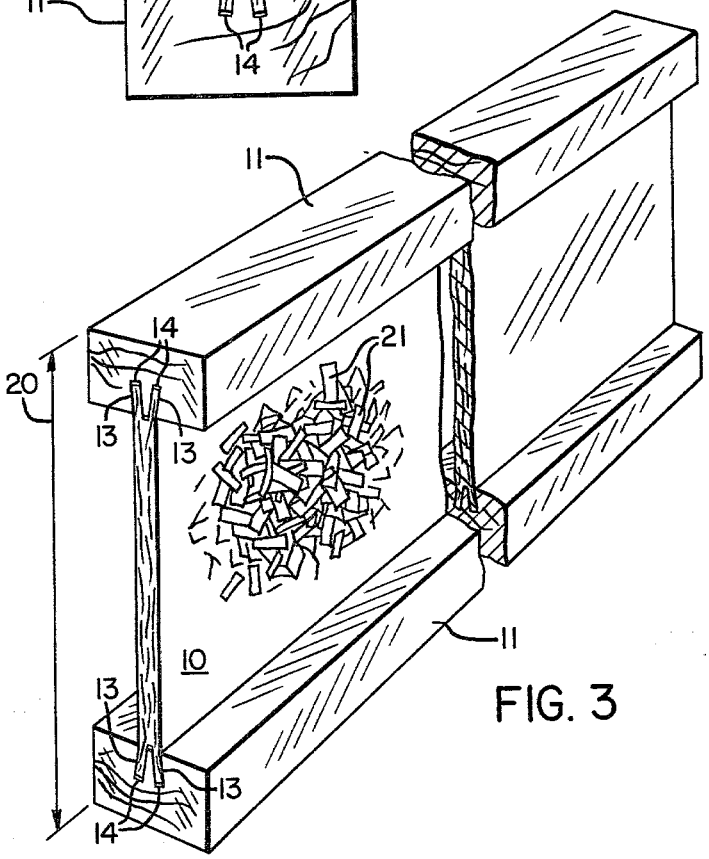
FIG. 3

FABRICATED WOOD STRUCTURAL MEMBER

CROSS-REFERENCES TO RELATED APPLICATIONS

This application is a continuation-in-part of Ser. No. 800,176, filed June 23, 1977 for MACHINE FOR ASSEMBLING WOOD I-BEAMS now U.S. Pat. No. 4,123,315; which is a continuation-in-part of Ser. No. 743,532 filed Nov. 5, 1976 for FABRICATED WOOD BEAM, now U.S. Pat. No. 4,074,498; which is a continuation-in-part of Ser. No. 558,350, filed Mar. 14, 1975 for PRESSED-IN DOVETAIL TYPE JOINT, now U.S. Pat. No. 3,991,535.

BACKGROUND OF THE INVENTION

This invention relates to a fabricated wood structural member which may be made in the form of an I-beam to serve either as a beam or a vertical wall stud or it may be made in the form of a triangular or bow-type roof turss.

U.S. Pat. No. 3,991,535 discloses a roof truss or I-beam having a plywood web member interconnecting a pair of wood chord members by means of glued tongue and groove joints. Face veneers form a pair of parallel tongues on the upper and lower edges of the plywood web member, the direction of the grain in the face veneers being perpendicular to the length of the web member. These tongues are pressed into inclined grooves in the chord members which bend the tongues across the grain and form self-locking dovetail-type joints which increase the strength of the I-beam or truss and hold the web and chord members in assembled relation without external clamps while the glue in the joints is setting.

U.S. Pat. No. 4,074,498 discloses an I-beam having a similar type of joint adapted to the use of a pair of plywood web members disposed in face to face relation to impart greater strength to the beam.

Pending application Ser. No. 809,176 illustrates and describes the beam in said U.S. Pat. No. 3,991,535.

Objects of the present invention are to provide a similar type of beam or truss using particleboard for the web member and to provide such a beam or truss having a particleboard web formed of boneed, interleafed, elongated thin wood flakes with the flakes disposed in random orientations substantially parallel with the plane of the web member so that a major proportion of the flakes in the tongues on the web member are bent across the grain of the wood when the tongues are pressed into inclined grooves in the chord members.

SUMMARY OF THE INVENTION

In the present construction the web member comprises a particleboard structural panel formed of bonded, interleafed, elongated, wafer-thin wood flakes disposed in random orientations substantially parallel with plane of the panel. The grain of the wood in each flake runs longitudinally of the flake. The thickness of each flake is smalll in relation to the thickness of a pair of parallel tongues formed on opposite edges of the web panel whereby each tongue contains many layers of said flakes and a major proportion of said flakes in each tongue are bent across the grain of the wood when the tongues are pressed into inclined grooves in the chord members. The width of the tongues is small in relation to the length of the flakes.

Thus, the bent tongues on each edge of the web panel form a self-locking dovetail-type joint which enhances the strength of the joint and holds the parts in assembled relation without external clamps while glue in the joint is setting.

The two chord members may be parallel with each other to form an I-beam or wall stud, they may have an angular relation to form a triangular roof truss or one chord member may be straight and the other bowed to form a bow truss.

The invention will be better understood and additional objects and advantages will become apparent from the following detailed description of the preferred embodiment illustrated on the accompanying drawing. Various changes may be made, however, in the details of construction and all such modifications within the scope of the appended claims are included in the invention.

BRIEF DESCRIPTION OF THE DRAWING

FIG. 1 is an end elevation view with parts broken away showing the method of assembly.

FIG. 2 is an end elevation view of an assembled beam.

FIG. 3 is a perspective view of the beam with parts broken away.

FIG. 4 is an enlarged perspective view of a wood flake in the web panel.

DESCRIPTION OF THE PREFERRED EMBODIMENT

The present structural member comprises a web 10 interconnecting a pair of longitudinal chord members 11. Longitudinal grooves 12 in two opposite edges of web 10 form a pair of parallel longitudinal tongues 13. Chord members 11 are wood, usually dimension lumber.

As shown in FIG. 1, each chord member 11 contains a pair of longitudinal grooves 14 having entrance portions 15 spaced apart to receive the tongues 13, the width of grooves 15 being equal to the thickness of tongues 13 and the space 16 between the entrance portions 15 of the grooves being equal to the width of the groove 12 between the tongues. Grooves 14 are divergent from entrance portions 15 to bend the tongues 13 out of parallelism and form a self-locking dovetail-type joint when the tongues are pressed into the grooves.

In practice, the two chord members 11 are pressed toward each other as indicated by arrows 17 to force the tongues 13 on opposite edges of web 10 into the grooves 14. Each groove 14 is inclined at an angle of approximately 5° from the plane of web 10 to produce the described bending of the tongues. Prior to the insertion of tongues 13 into grooves 14 either the tongues or the grooves are coated with a suitable adhesive. The self-locking characteristic of this dovetail-type joint holds the parts in assembled relation as shown in FIGS. 2 and 3 without external clamps while the glue is setting.

As described in said application Ser. No. 809,176, grooves 14 are slightly deeper than the length of tongues 13 so that, as seen in FIG. 2, the tongues do not seat in the bottoms of the grooves. This allows the structural member to be assembled to a predetermined standard width which is uniform throughout the length of the structural member as indicated by dimension line 20 in FIG. 3. Thus the present structural member may be substituted for a piece of solid wood dimension lumber without making any changes or adjustments in the dimensions called for on the building plans.

Web 10 is a type of particleboard formed of interleafed wafer-thin wood flakes 21. The flakes are of elongated configuration having substantially uniform length and thickness but of random width. The grain direction in each flake is longitudinal but the flakes assume random orientation in the particleboard as shown in FIG. 3. In the manufacture of the particleboard phenolic resin adhesive is applied to the flakes and the flakes in random orientation are then formed into thick mats and compressed at a thermosetting temperature into a strong, bonded, structural panel with the flakes parallel to the plane of the panel.

A typical wood flake 21 is illustrated in FIG. 4. The flakes have a uniform length L of approximately 1½" and a uniform thickness T of approximately 0.025". The width W may vary at random. The flake has its maximum thickness at mid-length and tapers to a feather edge at each end 22. The flakes are preferably cut from a hard wood species.

In the present illustration the thickness of each tongue 13 is ⅛" which is many times maximum thickness of a flake 21 whereby each tongue contains many layers of flakes. Since the flakes are in random orientation it is apparent that a major proportion of the flakes in each tongue 13 are bent across the grain at different angles when the tongues are bent to conform to the inclination of grooves 14. This imparts great strength to the interlocking joint making it an effective dovetail-type joint.

In the present example tongues 13 are ½" wide and grooves 14 slightly exceed ½" in depth. Thus the width of the tongues is one-third the length of the flakes whereby the major proportion of the flakes in each tongue extend across the bend line of the tongue at the bottom of groove 12.

This relationship further strenghens the tongues at their bend lines so that the result approaches a theoretical ideal configuration in which all the grain of the wood in the tongues would extend across the bend line in a perpendicular direction. Any reduction in strength resulting from flakes oriented transverse or nearly transverse to the bend line, or from flakes terminating right at the bend line, is compensated by the increased density of the wood resulting from the compression of the wood in the manufacture of the particleboard and the enhancement of strength by the resin adhesive.

The structural member illustrated on the drawing is designed as an I-beam to be erected in horizontal position for use as a garage door header for example. For such purpose the height dimension 20 in FIG. 3 is 11½" and the length is 16½ feet. The dimensions may be varied for other purposes such as floor joists and roof trusses and the beams may also be installed in vertical positions with appropriate dimensions for wall studs. All the dimensions recited herein are given by way of example and are not intended to limit the invention except to the extent that dimensions are included in certain claims.

Chord members 11 need not be parallel with each other. As shown in said U.S. Pat. No. 3,991,535 the chord members may assume an angular relationship to form a triangular roof truss. Also the upper chord member may be arched to form a bow truss. Web 10 may be one continuous panel extending the full length of chord members 11 or there may be a plurality of webs 10 abutting each other end to end or spaced apart longitudinally as shown in said U.S. Pat. No. 3,991,535.

Also, for increased strength, a pair of web panels may be juxtaposed face to face with dovetail-type tongue and groove joints interconnecting the chord members as shown in said U.S. Pat. No. 4,074,498.

Thus it is possible to fabricate a variety of structural members with particleboard webs between a pair of wood chord members without any metal parts or fastenings. Assembly may be accomplished rapidly in substantially continuous work flow. There is a considerable saving in wood in the production of fabricated members to meet specified strength requirements, particularly in comparison with solid wood beams and floor joists in the form of conventional dimension lumber. This is important for the conservation of natural resources as well as from the cost standpoint.

What is claimed is:

1. A structural load bearing member comprising a pair of elongated chord members of wood material and a web interconnecting said chord members by means of glued tongue and groove joints, said joints comprising a pair of parallel, spaced apart bendable tongues on two opposite edges of said web and a pair of longitudinal grooves in each of said chord members spaced apart to receive said tongues, said grooves in each chord member being inclined from top to bottom relative to each other to bend said tongues out of parallelism with each other and form a selflocking dovetail-type joint when said chord members are pressed onto said web tongues, said joints holding said web and chord members together in assembled relation without external clamps while said glue in said joints is setting; said web comprising a particleboard structural panel formed of bonded, interleafed, elongated thin wood flakes, with the grain of the wood in each flake running longitudinally of the flake, said flakes being disposed in random orientations substantially parallel with the plane of the panel, the thickness of each flake being small in relation to the thickness of said tongues and the width of said tongues being small in relation to the length of said flakes whereby each tongue contains many layers of said flakes and a major proportion of said flakes in each tongue is bent across the grain of the wood when the tongues are pressed into said inclined grooves.

2. A structural member as defined in claim 1, said tongues having a thickness not less than approximately one-eighth inch and said flaees having a thickness not exceeding approximately twenty-five thousandths of an inch, said tongues having a width of approximately one-half inch and said flakes having a length of approximately one and one-half inches.

3. A structural member as defined in claim 1, said web being homogeneous, of single panel thickness, the outside surfaces of said tongues being the opposite faces of the panel.

4. A structural member as defined in claim 1, said chord members being parallel with each other to form an I-beam.

* * * * *